US010285461B2

(12) United States Patent
Hanson Allen

(10) Patent No.: US 10,285,461 B2
(45) Date of Patent: May 14, 2019

(54) REVERSIBLE COMPRESSION GARMENTS AND METHODS OF ASSEMBLING AND USING SAME

(71) Applicant: Spanx, Inc., Atlanta, GA (US)

(72) Inventor: Wendy Hanson Allen, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 555 days.

(21) Appl. No.: 13/874,462

(22) Filed: Apr. 30, 2013

(65) Prior Publication Data

US 2014/0317823 A1 Oct. 30, 2014

(51) Int. Cl.
*A41D 15/00* (2006.01)

(52) U.S. Cl.
CPC ..... *A41D 15/005* (2013.01); *A41B 2400/38* (2013.01); *A41D 2400/38* (2013.01)

(58) Field of Classification Search
CPC ..... A41B 1/08; A41B 11/00; A41D 15/005; A41D 27/00
USPC ..... 2/DIG. 2
See application file for complete search history.

(56) References Cited

U.S. PATENT DOCUMENTS 686,699 A * 11/1901 Bandler ..... A41D 1/04 2/102
1,538,847 A * 5/1925 Wheeler ..... A42B 1/206 2/195.7
1,731,137 A * 10/1929 Jones ..... A41D 1/22 2/48
1,834,331 A * 12/1931 Cameron ..... A41B 9/06 2/211
2,138,041 A * 11/1938 Preston ..... A41D 1/02 2/93
2,722,686 A * 11/1955 Hoskings ..... A41D 15/00 2/74
2,890,460 A * 6/1959 Levi ..... A41D 15/005 2/115
2,948,900 A * 8/1960 Ebenstein ..... A42B 1/041 2/195.7
3,187,345 A * 6/1965 Holford ..... A42B 1/041 2/195.7
3,492,676 A * 2/1970 King ..... A41D 15/005 2/106
3,820,165 A * 6/1974 Negherbon ..... A41D 1/22 2/74
4,453,274 A * 6/1984 Allen ..... A41D 1/04 2/102
4,472,835 A * 9/1984 Clark ..... A41D 13/00 2/102

(Continued)

FOREIGN PATENT DOCUMENTS

DE 3635606 A1 * 4/1988 ..... A41D 15/005

*Primary Examiner* — Sally Haden
(74) *Attorney, Agent, or Firm* — Meunier Carlin & Curfman LLC

(57) ABSTRACT

Disclosed herein are reversible compression garments. In some embodiments, the garments are two-layer, reversible compression garments. In some embodiments, the garments are inside-out reversible, forward/backward reversible, or a combination thereof. The reversible compression garment can be, for instance, a mid-thigh pant or a tank top. Also disclosed herein are methods of assembling and using the reversible compression garments disclosed herein.

24 Claims, 6 Drawing Sheets

(56) References Cited

U.S. PATENT DOCUMENTS

| | | | | |
|---|---|---|---|---|
| 4,686,714 | A * | 8/1987 | Harley | A41D 15/005 2/105 |
| 5,561,860 | A * | 10/1996 | Nguyen-Senderowicz | A41D 15/005 2/115 |
| 5,701,712 | A * | 12/1997 | Andersen | A41B 1/00 2/69 |
| 6,345,393 | B1 * | 2/2002 | Bayer | A41D 3/02 2/94 |
| 7,251,840 | B2 * | 8/2007 | Bayer | A41D 3/00 2/227 |
| 7,306,505 | B2 * | 12/2007 | Barbour | A41C 3/0057 2/DIG. 2 |
| 7,441,281 | B2 * | 10/2008 | Salem | A41D 1/04 2/115 |
| 7,591,706 | B2 | 9/2009 | Barbour et al. | |
| 8,568,195 | B1 | 10/2013 | Schindler | |
| 9,015,863 | B2 * | 4/2015 | Brown | A41D 13/0015 2/69 |
| 2005/0044604 | A1 * | 3/2005 | Salem | A41D 15/005 2/69 |
| 2006/0218693 | A1 * | 10/2006 | Sinohui, Jr. | A41D 15/005 2/115 |
| 2011/0003533 | A1 | 1/2011 | Caruso | |
| 2011/0131698 | A1 * | 6/2011 | Swomley | A41D 11/00 2/75 |
| 2012/0284894 | A1 * | 11/2012 | Brown | A41D 13/0015 2/69 |
| 2013/0254968 | A1 * | 10/2013 | Gregory | A41D 15/005 2/69 |
| 2014/0182043 | A1 * | 7/2014 | Moore | A41D 15/005 2/69 |

* cited by examiner

REVERSIBLE COMPRESSION GARMENTS AND METHODS OF ASSEMBLING AND USING SAME

FIELD OF THE DISCLOSURE

The present disclosure relates to reversible compression garments. In some embodiments, the garments are two-layer, reversible compression garments. The present disclosure also relates to methods of assembling and using reversible compression garments.

BACKGROUND

Many people face recurring problems with bulges of undesirable body fat on their torso (e.g., abdominal fat, back fat, etc.) and or legs (e.g., thigh fat). Designers have produced a variety of garments designed to restrain, smooth, and conceal undesirable bulges of body fat. However, a need exists for improved garments that can restrain, smooth, and conceal undesirable bulges of body fat in garments that can be worn in a variety of ways (e.g., reversible garments).

SUMMARY OF THE DISCLOSURE

Disclosed herein are reversible compression garments. In some embodiments, the garments are inside-out reversible, and forward/backward reversible. In some embodiments, the garment comprises a front portion comprising a first panel and a second panel, wherein the first panel and second panel each comprise a sufficient amount of synthetic fibers (e.g., nylon, spandex) to provide compression, wherein the first panel and the second panel have mirror-cut shapes, and wherein the first panel and second panel are at least partially attached (e.g., by sewing, serging, adhering, zipping, buttoning, snapping, heat sealing, welding, gluing, bonding, laser cutting, and combinations thereof) along corresponding peripheral edges of the first and second panels so that the panels are slidable with respect to each other between the peripheral edges. In some embodiments, the garment further comprises a back portion comprising a third panel and a fourth panel, wherein the third panel and fourth panel each comprise a sufficient amount of synthetic fibers to provide compression, wherein the third panel and the fourth panel have mirror-cut shapes, wherein the third panel and fourth panel are at least partially attached along the corresponding peripheral edges of the first and second panels so that the panels are slidable with respect to each other between the peripheral edges, and wherein the front portion is at least partially attached to the back portion along the peripheral edges.

In some embodiments, the garment is a shirt, t-shirt, camisole, strapless top, tube top, brassiere, bustier, or tank-top. A top of the front portion (e.g., the neckline of the garment) can have a different shape than a top of the back portion. For instance, the top can have a scoop-neck or V-neck shape. The interior of the two-layer garment can have different visual characteristics (e.g., color, texture, pattern) than the exterior of the two-layer garment. In some embodiments, the garment is a pair of pants, jeans, a pair of shorts, underwear, a panty, a pair of Capri pants, a slip, a half-slip, a mid-thigh pant, a skirt, leggings, or tights. The garment can comprise a gusset comprising natural fibers (e.g., cotton).

Also disclosed herein are methods of assembling reversible compression garments. In some embodiments, the method of assembling a reversible compression garment comprises cutting a first panel with a peripheral edge from a compression fabric having a first visual characteristic, cutting a second panel with a peripheral edge mirroring the peripheral edge of the first panel from a compression fabric having a second visual characteristic different from the first visual characteristic, and attaching the corresponding peripheral edges of the first and second panels so that the panels are slidable with respect to each other between the peripheral edges.

A method of using the garment in four ways is also disclosed herein. In some embodiments, the method of using the garment comprises wearing the garment with the first panel facing outward from the garment wearer's front torso, removing the garment and putting it on backward to wear the garment with the fourth panel facing outward from the garment wearer's front torso, removing the garment, turning the garment inside out and wearing the garment with the second panel facing outward from the garment wearer's front torso, removing the garment and putting it on backward to wear the garment with the third panel facing outward from the garment wearer's front torso, or a combination thereof.

The description below sets forth details of one or more embodiments of the present disclosure. Other features, objects, and advantages will be apparent from the description and from the claims.

DETAILED DESCRIPTION

Disclosed herein are reversible compression garments, and methods of assembling and using the same.

The reversible compression garments disclosed herein can be any garment wherein restraining, smoothing, or concealing bulges of fat (e.g., abdominal fat or leg fat) could be desirable. In some embodiments, the reversible compression garment is a pair of pants, jeans, a pair of shorts, underwear, a panty, Capri pants, a slip, a half-slip, a mid-thigh pant, a skirt, leggings, or tights. In some embodiments, the garment is a shirt, t-shirt, camisole, strapless top, tube top, brassiere, bustier, or tank-top.

Disclosed herein are reversible compression garments. In some embodiments, the garments are inside-out reversible, and forward/backward reversible. The garment can comprise any fabric or fibers known in the art for use in a compression garment. The garment can comprise a natural fabric or fiber, a synthetic fabric or fiber, or a blended fabric comprising multiple fibers, so long as adequate compression is provided to give the desired smoothing, contouring, restraining/concealing body fat, or combinations thereof to the garment wearer. In some embodiments, the reversible compression garment comprises denim, twill, woven fabric, or knit fabric. Exemplary reversible compression garments can comprise, for example, cotton, leather, faux leather, suede, faux suede, polyester, denim, twill, tweed, wood pulp, bamboo, corn fibers, leaves, moleskin, barkcloth, barathea, silk, rayon, nylon, wool, batiste, Bedford cord, bengaline, acetate, berber fleece, burlap, flannel, canvas, lace, goat skin, satin, sateen, charmeuse, cheesecloth, corduroy, linen, crinoline, velvet, spandex, animal pelts, faux animal pelts, jersey, terry cloth, velour, velveteen, nonwoven fabrics such as felt, and blends thereof. The reversible compression garment can comprise any number of layers of fabric. In some embodiments, the reversible compression garment comprises one layer. In some embodiments, the reversible compression garment comprises two layers. The reversible compression garment can comprise, for instance, a bonded fabric comprising two or more layers joined together with, for instance, an adhesive, resin, foam, fusible membrane, or sewn together.

Figure 2:
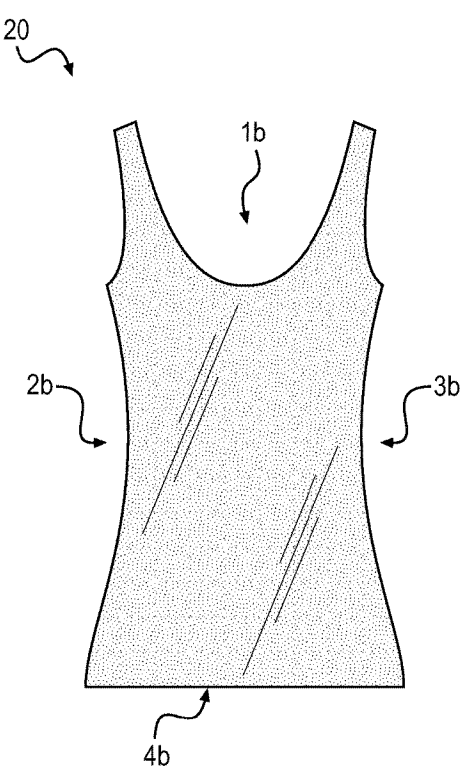
FIG. 2 depicts an embodiment of a second panel that can be used to construct a reversible compression garment disclosed herein.
Figure 1:
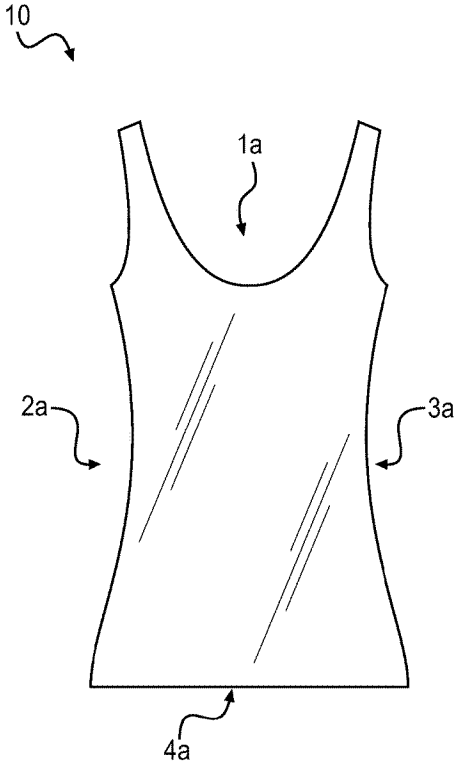
FIG. 1 depicts an embodiment of a first panel that can be used to construct a reversible compression garment disclosed herein.
Figure 4:
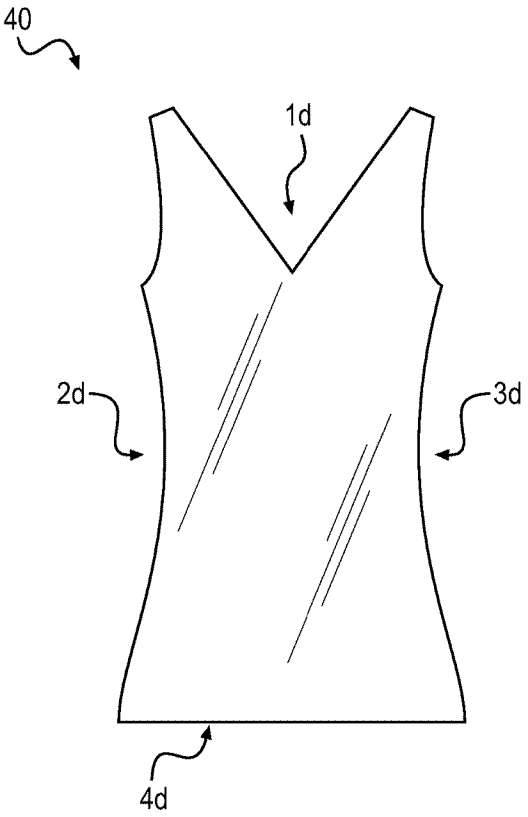
FIG. 4 depicts an embodiment of a fourth panel that can be used to construct a reversible compression garment disclosed herein.
Figure 3:
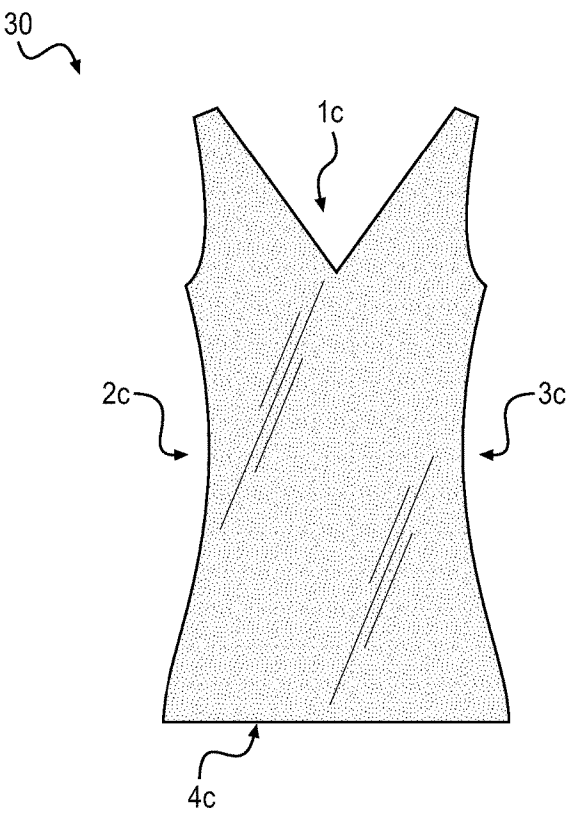
FIG. 3 depicts an embodiment of a third panel that can be used to construct a reversible compression garment disclosed herein.
Figure 5B:
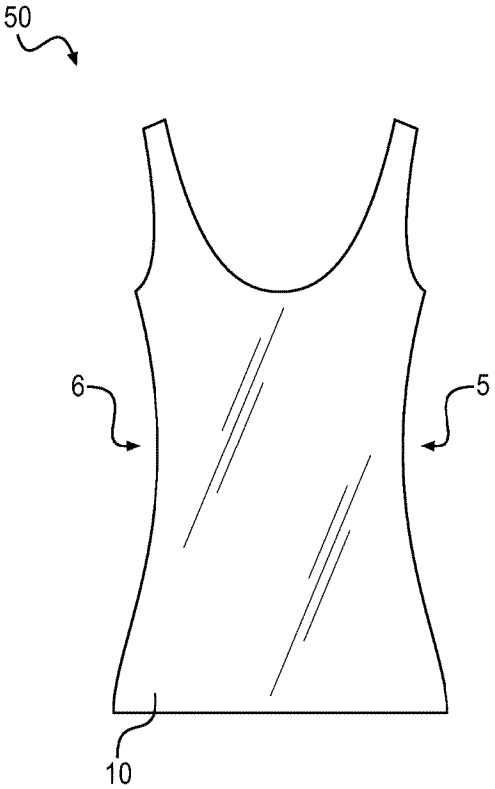
FIG. 5B depicts a rear view of an embodiment of a front portion that can be used to construct a reversible compression garment disclosed herein.
Figure 5A:
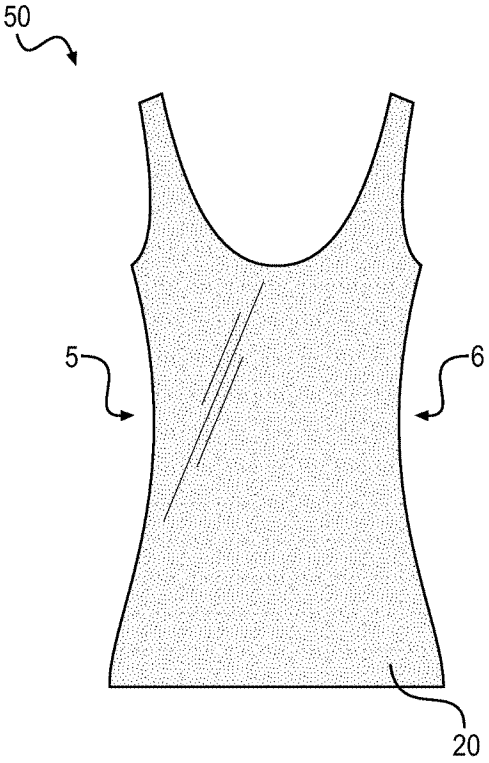
FIG. 5A depicts a front view of an embodiment of a front portion that can be used to construct a reversible compression garment disclosed herein.
Figure 6B:
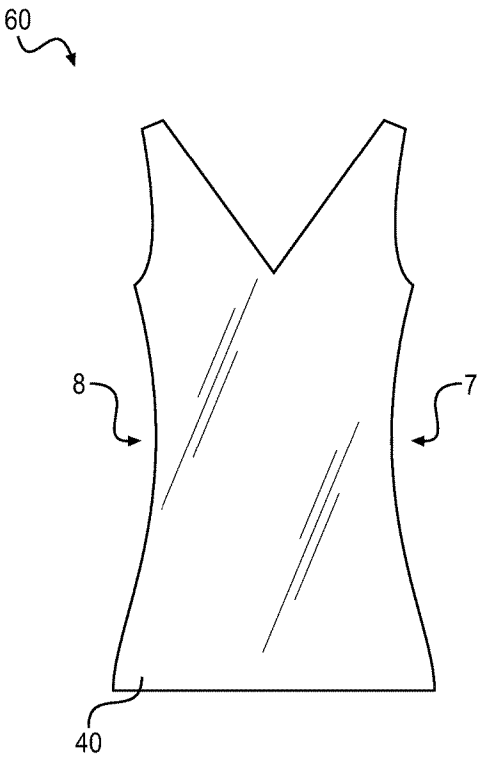
FIG. 6B depicts a rear view of an embodiment of a back portion that can be used to construct a reversible compression garment disclosed herein.
Figure 6A:
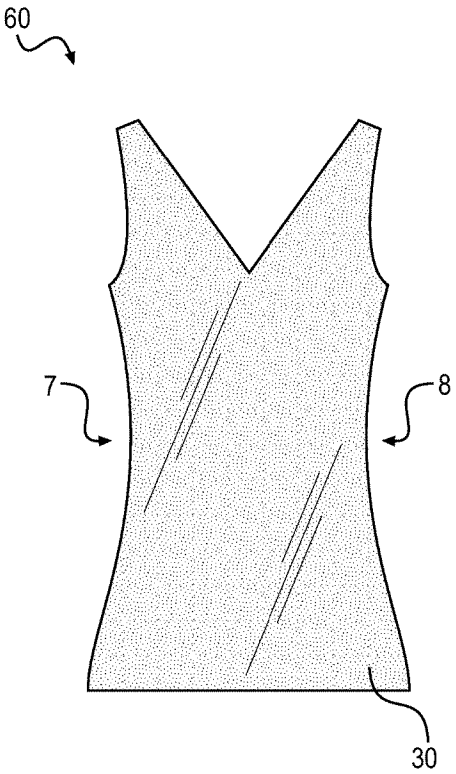
FIG. 6A depicts a front view of an embodiment of a back portion that can be used to construct a reversible compression garment disclosed herein.
Figure 7B:
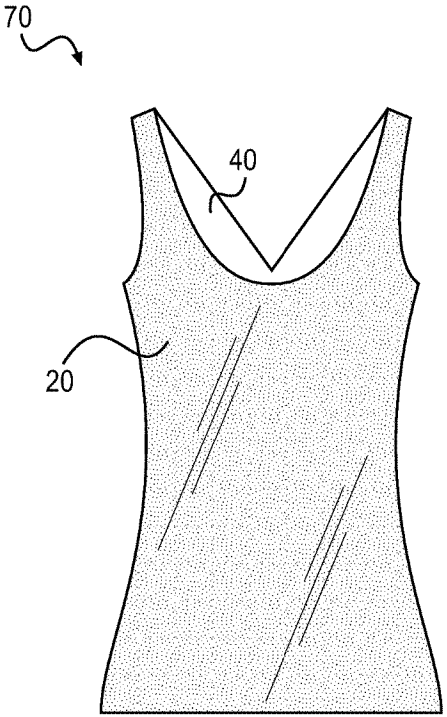
FIG. 7B depicts a second wearable configuration of a reversible compression garment disclosed herein.
Figure 7A:
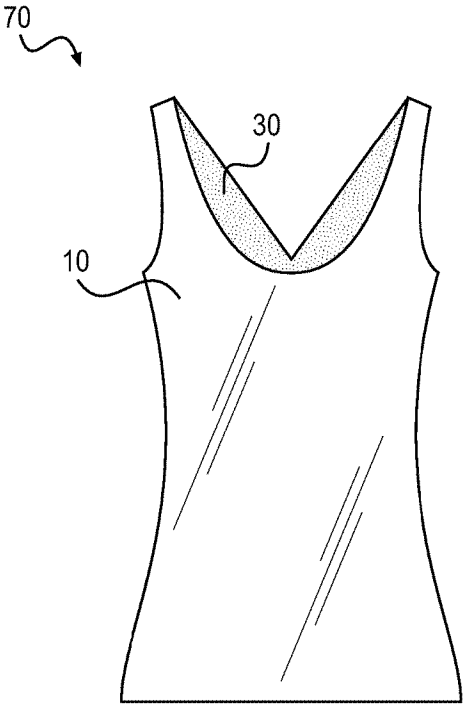
FIG. 7A depicts a first wearable configuration of a reversible compression garment disclosed herein.
Figure 7D:
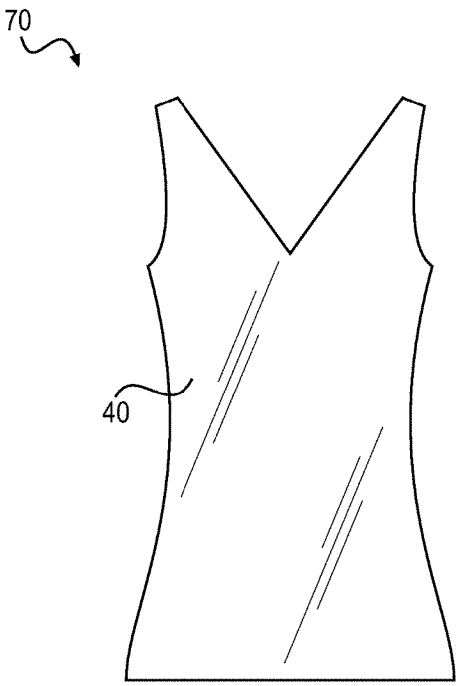
FIG. 7D depicts a fourth wearable configuration of a reversible compression garment disclosed herein.
Figure 7C:
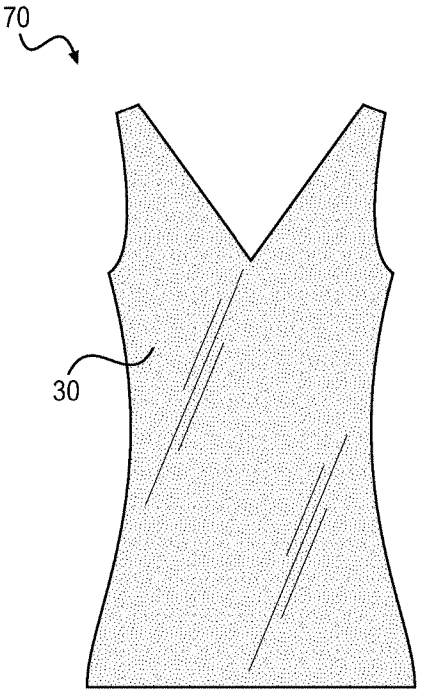
FIG. 7C depicts a third wearable configuration of a reversible compression garment disclosed herein.

In some embodiments, the reversible compression garment 70 (see FIGS. 7A-7D) comprises a front portion 50 (see FIGS. 5A and 5B) comprising a first panel 10 (see FIG. 1) and a second panel 20 (see FIG. 2), wherein the first panel and second panel each comprise a sufficient amount of synthetic fibers to provide compression, wherein the first panel and the second panel have mirror-cut shapes, and wherein the first panel and second panel are at least partially attached along corresponding peripheral edges (including the top 1*a*, first lateral edge 2*a*, second lateral edge 3*a*, and bottom 4*a*) of the first panel and the peripheral edges (including the top 1*b*, first lateral edge 2*b*, second lateral edge 3*b*, and bottom 4*b*) of the second panel so that the panels are slidable with respect to each other between the peripheral edges. In some embodiments, the garment further comprises a back portion 60 (see FIGS. 6A and 6B) comprising a third panel 30 (see FIG. 3) and a fourth panel 40 (see FIG. 4), wherein the third panel and fourth panel each comprise a sufficient amount of synthetic fibers to provide compression, wherein the third panel and the fourth panel have mirror-cut shapes, wherein the third panel and fourth panel are at least partially attached along the corresponding peripheral edges (including the top 1*c*, first lateral edge 2*c*, second lateral edge 3*c*, and bottom 4*c*) of the third panel and the peripheral edges (including the top 1*d*, first lateral edge 2*d*, second lateral edge 3*d*, and bottom 4*d*) of the fourth panel so that the panels are slidable with respect to each other between the peripheral edges, and wherein the lateral edges 5 and 6 of front portion 50 is at least partially attached to the lateral edges 7 and 8 of back portion 60.

In some embodiments, the reversible compression garment comprises sufficient synthetic fibers to provide adequate compression on the garment wearer. In some embodiments, the reversible compression garment comprises an elastomer. In some embodiments, the elastomer is spandex. In some embodiments, the reversible compression garment comprises a spandex blend. In some embodiments, the reversible compression garment comprises a polyester/spandex blend. In some embodiments, the reversible compression garment comprises a nylon/spandex blend. In some embodiments, the reversible compression garment comprises a rayon/spandex blend. In some embodiments, the reversible compression garment comprises a nylon/lycra blend. In some embodiments, the reversible compression garment comprises a polyester/lycra blend. In some embodiments, the reversible compression garment comprises a rayon/lycra blend. In some embodiments, the reversible compression garment comprises 50% or less of spandex (e.g., 40% or less, 35% or less, 30% or less, 25% or less, 20% or less, or 15% or less). In some embodiments, the reversible compression garment comprises 10% or greater of spandex (e.g., 15% or greater, 20% or greater, 25% or greater, 30% or greater, 35% or greater, or 40% or greater). In some embodiments, the reversible compression garment comprises 90% or less of nylon (e.g., 85% or less, 80% or less, 75% or less, 70% or less, or 60% or less). In some embodiments, the reversible compression garment comprises 50% or greater of nylon (e.g., 60% or greater, 65% or greater, 70% or greater, 75% or greater, 80% or greater, or 85% or greater). In some embodiments, the reversible compression garment comprises 40% or less of polyester (e.g., 30% or less, 25% or less, 20% or less, 15% or less, or 10% or less). In some embodiments, the reversible compression garment comprises 5% or greater of polyester (e.g., 10% or greater, 15% or greater, 20% or greater, 25% or greater, 30% or greater, or 35% or greater). In some embodiments, the reversible compression garment comprises modal, rayon, and spandex. The reversible compression garment can be made, for instance, by circular knitting, warp knitting, or any weaving or knitting technique known in the art. In some embodiments, the reversible compression garment has varied properties. For instance, the reversible compression garment can have a gradient of elasticity, horizontally or vertically across the reversible compression garment. In some embodiments, the reversible compression garment comprises a denser fabric at the bottom. In some embodiments, the reversible compression garment comprises a less dense fabric at the top. In some embodiments, the reversible compression garment comprises a double layer with sandwiched elastic at the waist. In some embodiments, the reversible compression garment comprises a single layer with no elastic.

In some embodiments, select panels have mirror-cut shapes having the same outline and shape with a variation of less than 5% or 10% between the mirror-cut panels. The fabric or fiber composition of the panels can impact the compression. Compression can be measured by the modulus and elongation in accordance with, for instance, ASTM 4964. In some embodiments, the panels may have elongation and/or modulus values in Table 1 below.

TABLE 1

Exemplary Elongation/Modulus Values for One-Layer and Two-Layer Reversible Compression Garments

| Direction of Fabric | Elongation (1 layer of fabric) | Modulus (1 layer of fabric at 50% extension) | Modulus of 2 Layers of fabric at 50% extension at Specified Elongation | Compression Range of Modulus of 2 Layers of TE08148 Fabric |
|---|---|---|---|---|
| Length | 193% | .63 lbs | 1.26 lbs | +/−25% from midpoint Range: .95-1.58 lbs of force |
| Width | 118% | .68 lbs | 1.36 lbs | +/−25% from midpoint Range: 1.02-1.70 lbs of force |

The cut of the panels can be adjusted to affect the compressibility of the garment in targeted areas. In some embodiments, the garment (and the panels therein) are cut in an hour-glass shape to provide additional compression to the garment wearer's waist.

The inside of the reversible compression garment has different visual characteristics than the outside of the reversible compression garment, allowing the garment wearer to have different visual appearance depending on which side of the garment faces outward during wear. This can be accomplished by selection of the visual characteristics of the panels (see FIGS. 1-4). In some embodiments, the first panel and the fourth panel have a first visual characteristic. In some embodiments, the second panel and the third panel have a second visual characteristic different from the first visual characteristic. In some embodiments, the visual characteristics include texture, color, pattern, or combinations thereof. When assembled, the garment can be configured such that the first panel and fourth panel face outward during wear to give one visual appearance (see FIGS. 7A and 7D). When assembled, the garment can be configured such that the third panel and second panel face outward during wear to give another visual appearance (see FIGS. 7B and 7C). In some embodiments, the visual characteristic is a black color. In some embodiments, the visual characteristic is a nude color. This configuration described above shows an embodiment of inside-out reversibility.

In addition, the garment can be forward/backward reversible. One embodiment of forward/backward reversibility is shown in the FIGURES. For instance, a different neckline shape in the front (e.g., scoop-neck) compared to the back (e.g., V-neck) of a garment allows the garment wearer to wear the garment with either neckline facing forward (see, e.g., FIGS. 7A and 7B with a scoop-neck neckline facing forward and FIGS. 7C and 7D with a V-neck neckline facing forward). Any neckline shape known or desired can be used, including but not limited to V-neck, scoop-neck, sweetheart, Queen Anne, empire, cowl neck, Sabrina, deep Sabrina, boat neck, square neck, bateau, plunging, surplice, or portrait.

The panels in the reversible compression garment can be attached together by any means capable of attaching garment layers together. The front portion and the back portion of the reversible compression garment can be attached together by any means capable of attaching garment sections together. In some embodiments, the panels and/or sections are attached together by sewing, serging, zipping, buttoning, snapping, heat sealing, welding, gluing, bonding, laser cutting, and combinations thereof. In some embodiments, the bottoms of the panels are attached by bonding (e.g., the bottom 4*a* of panel 10 is bonded to bottom 4*b* of panel 20) for a smoother appearance. In some embodiments, the lateral edges of the panels or portions are attached by sewing (e.g., lateral edge 3*a* of panel 10 can be sewn to lateral edge 3*b* of panel 20 to form lateral edge 6 of the front panel 50).

In some embodiments, the garment is a pair of pants, jeans, a pair of shorts, underwear, a panty, a pair of Capri pants, a slip, a half-slip, a mid-thigh pant, a skirt, leggings, or tights. The garment can comprise a gusset comprising natural fibers (e.g., cotton).

The reversible compression garment can be configured to extend across, for instance, a garment-wearer's abdominal region to a greater or lesser amount, depending on the amount of abdominal coverage desired by the garment wearer. And in embodiments where more of the garment-wearer's abdominal region can be covered by the reversible compression garment, greater smoothing, restraining, and/or concealing of undesirable bulges of abdominal fat can be achieved. Further, the reversible compression garments disclosed herein conveniently reduce or eliminate the undesirable fat bulges of the garment wearer while providing, for instance, two or four fashionably different wearing options for the garment wearer. The garments described herein give the garment wearer the desired smoothing, shaping, and concealing that can come with compression garments while giving multiple style options to the wearer.

Also disclosed herein are methods of assembling reversible compression garments. In some embodiments, the method of assembling a reversible compression garment comprises cutting a first panel with a peripheral edge from a compression fabric having a first visual characteristic, cutting a second panel with a peripheral edge mirroring the peripheral edge of the first panel from a compression fabric having a second visual characteristic different from the first visual characteristic, and attaching the corresponding peripheral edges of the first and second panels so that the panels are slidable with respect to each other between the peripheral edges. Many methods of assembly are possible. For instance, an inner garment layer with one visual characteristic can be assembled via any of the attachment methods described herein, an outer garment layer with another visual characteristic can be assembled via any of the attachment methods described herein, and then the inner and outer layers can be attached to one another. Or, the front portion can be assembled and then attached to an assembled back portion.

A method of using the garment in four ways is also disclosed herein. In some embodiments, the method of using the garment comprises wearing the garment with the first panel facing outward from the garment wearer's front torso, removing the garment and putting it on backward to wear the garment with the fourth panel facing outward from the garment wearer's front torso, removing the garment, turning the garment inside out and wearing the garment with the second panel facing outward from the garment wearer's front torso, removing the garment and putting it on backward to wear the garment with the third panel facing outward from the garment wearer's front torso, or a combination thereof.

The garments and methods of the appended claims are not limited in scope by the specific garments and methods described herein, which are intended as illustrations of a few aspects of the claims and any garments and methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed.

What is claimed is:

1. A reversible compression garment, the garment comprising:

a front portion comprising a first panel and a second panel, wherein:

the first panel and the second panel each comprises synthetic fibers to provide compression;

the first panel and the second panel have mirror-cut shapes, the first panel and the second panel each having a top edge, two lateral edges, and a bottom edge, and wherein the first panel and the second panel have lengths that are substantially the same;

an inner surface of the first panel and an inner surface of the second panel are at least partially attached along the respective top edges of the first panel and the second panel to form a top edge of the front portion, the top edge of the front portion comprising a neckline that defines a topmost edge of the front portion, and the inner surface of the first panel and the inner surface of the second panel are at least partially attached along the respective two lateral edges of each of the first panel and the second panel to form a pair of lateral edges of the front portion, so that the first and second panels are slidable with respect to each other between the top edge and the pair of lateral edges of the front portion, and wherein the bottom edge of the first panel and the bottom edge of the second panel each has a bottommost edge, wherein the bottommost edge of the first panel and the bottommost edge of the second panel are connected to each other by one or more attachments extending between the inner surfaces of the first panel and second panel, such that a bottommost edge of the front portion is defined by the bottommost edges of the first panel and the second panel; and an outer surface of the first panel and an outer surface of the second panel having a smooth appearance, and when the outer surface of the first panel is visible, no portion of the second panel is visible, and when the outer surface of the second panel is visible, no portion of the first panel is visible; and a back portion comprising a third panel and a fourth panel, wherein;

the third panel and the fourth panel each comprises synthetic fibers to provide compression;

the third panel and the fourth panel have mirror-cut shapes, the third panel and the fourth panel each having a top edge, two lateral edges, and a bottom edge, and wherein the third panel and the fourth panel have lengths that are substantially the same;

an inner surface of the third panel and an inner surface of the fourth panel are at least partially attached along the respective top edges of the third panel and the fourth panel to form a top edge of the back portion, the top edge of the back portion comprising a neckline that defines a topmost edge of the back portion, and the inner surface of the third panel and the inner surface of the fourth panel are at least partially attached along the respective two lateral edges of each of the third panel and fourth panel to form a pair of lateral edges of the back portion, so that the third and fourth panels are slidable with respect to each other between the top edge and the pair of lateral edges of the back portion, and wherein the bottom edge of the third panel and the bottom edge of the fourth panel each has a bottommost edge, wherein the bottommost edge of the third panel and the bottommost edge of the fourth panel are connected to each other by one or more attachments extending between the inner surfaces of the third panel and fourth panel, such that a bottommost edge of the back portion is defined by the bottommost edges of the third panel and the fourth panel; and an outer surface of the third panel and an outer surface of the fourth panel having a smooth appearance, and when the outer surface of the third panel is visible, no portion of the fourth panel is visible, and when the outer surface of the fourth panel is visible, no portion of the third panel is visible; and wherein the front portion is at least partially attached to the back portion respectively along the pair of lateral edges of the front portion and the pair of lateral edges of the back portion.

2. The garment of claim 1, wherein the top edge of the front portion has a different shape than the top edge of the back portion.

3. The garment of claim 2, wherein the top edge of the front portion has a scoop-neck shape.

4. The garment of claim 2, wherein the top edge of the back portion has a V-neck shape.

5. The garment of claim 1, wherein the outer surface of the first panel has a visual characteristic and the outer surface of the second panel has a visual characteristic, wherein the visual characteristic of the outer surface of the first panel and the visual characteristic of the outer surface of the second panel are different.

6. The garment of claim 5, wherein the outer surface of the third panel has a visual characteristic and the outer surface of the fourth panel has a visual characteristic, wherein the visual characteristic of the outer surface of the third panel and the visual characteristic of the outer surface of the fourth panel are different.

7. The garment of claim 6, wherein the visual characteristic of the outer surface of the first panel and the visual characteristic of the outer surface of the fourth panel are the same.

8. The garment of claim 7, wherein the visual characteristic of the outer surface of the second panel and the visual characteristic of the outer surface of the third panel are the same.

9. The garment of claim 8, wherein the visual characteristics of the first, second, third, and fourth panels include color, texture, pattern, or combinations thereof.

10. The garment of claim 8, wherein the visual characteristics of the outer surface of the first panel and the outer surface of the fourth panel includes black color.

11. The garment of claim 10, wherein the visual characteristics of the outer surface of the second panel and the outer surface of the third panel includes nude color.

12. The garment of claim 8, wherein the lateral edges of the first panel, second panel, third panel, and fourth panel have an hour-glass shape configured to compress the abdominal section of the garment wearer.

13. The garment of claim 1, wherein the synthetic fibers of the first panel, the second panel, the third panel, the fourth panel, or combinations thereof comprise nylon.

14. The garment of claim 1, wherein the synthetic fibers of the first panel, the second panel, the third panel, the fourth panel, or combinations thereof comprise from 50% to 90% nylon.

15. The garment of claim 1, wherein the synthetic fibers of the first panel, the second panel, the third panel, the fourth panel, or combinations thereof comprise an elastomer.

16. The garment of claim 15, wherein the elastomer is spandex.

17. The garment of claim 1, wherein the synthetic fibers of the first panel, the second panel, the third panel, the fourth panel, or combinations thereof comprise from 10% to 50% spandex.

18. The garment of claim 1, wherein the top and lateral edges of the first panel are respectively attached to the top and lateral edges of the second panel using sewing, serging, adhering, zipping, buttoning, snapping, heat sealing, welding, gluing, bonding, laser cutting, or combinations thereof.

19. The garment of claim 1, wherein the top and lateral edges of the third panel are respectively attached to the top and lateral edges of the fourth panel using sewing, serging, adhering, zipping, buttoning, snapping, heat sealing, welding, gluing, bonding, laser cutting, or combinations thereof.

20. The garment of claim 1, wherein the front portion is attached to the back portion using one of a group consisting of sewing, serging, adhering, zipping, buttoning, snapping, heat sealing, welding, gluing, bonding, laser cutting, and combinations thereof.

21. The garment of claim 1, wherein the pair of lateral edges of the front portion and the pair of lateral edges of the back portion are attached by sewing.

22. The garment of claim 1, wherein the first panel, second panel, third panel, and fourth panel each independently consist essentially of synthetic fibers.

23. The garment of claim 1, wherein the mirror-cut shapes of the first panel, second panel, third panel, and fourth panel have outlines and shapes with a variation of less than 5% or 10%.

24. The garment of claim 1, wherein the one or more attachments comprise means for attaching.

* * * * *